US005584222A

United States Patent [19]

Engsbråten et al.

[11] Patent Number: 5,584,222

[45] Date of Patent: Dec. 17, 1996

[54] METHOD FOR CHARGING BORE-HOLES WITH EXPLOSIVE

[75] Inventors: Björn Engsbråten, Dolomitvägen; Rolf Magnusson, Rörebro, both of Sweden

[73] Assignee: Nitro Nobel AB, Nora, Sweden

[21] Appl. No.: 620,395

[22] Filed: Mar. 22, 1996

Related U.S. Application Data

[63] Continuation of Ser. No. 200,487, Feb. 23, 1994, abandoned.

[30] Foreign Application Priority Data

Feb. 25, 1993 [SE] Sweden ..... 9300633

[51] Int. Cl.[6] ..... F42B 3/00

[52] U.S. Cl. ..... 86/20.15; 102/312; 102/313

[58] Field of Search ..... 102/312, 313; 86/20.15

[56] References Cited

U.S. PATENT DOCUMENTS

| | | | |
|---|---|---|---|
| 3,063,373 | 11/1962 | Boddorff et al. | 102/23 |
| 3,541,797 | 11/1970 | Stewart | 61/35 |
| 3,921,497 | 11/1975 | Christman et al. | 86/20 C |
| 3,949,673 | 4/1976 | Lyerly | 102/24 R |
| 4,066,093 | 1/1978 | Egerstrom | 102/313 X |
| 4,555,279 | 11/1985 | Funk | 149/92 |
| 4,669,060 | 10/1987 | Vuillaume et al. | 102/313 X |
| 4,936,933 | 6/1990 | Yabsley et al. | 149/109.6 |
| 4,966,077 | 10/1990 | Halliday et al. | 102/313 |
| 4,995,925 | 2/1991 | Engsbraten | 102/312 X |
| 5,007,345 | 4/1991 | O'Garr | 102/313 |
| 5,069,108 | 12/1991 | Dion | 86/20.15 |
| 5,105,743 | 4/1992 | Tano et al. | 102/312 X |
| 5,233,926 | 8/1993 | Carmichael et al. | 102/302 |
| 5,513,570 | 5/1996 | Mulcahy | 102/312 |

FOREIGN PATENT DOCUMENTS

| | | |
|---|---|---|
| 37067/89 | 1/1990 | Australia . |
| 2584179 | 1/1987 | France . |
| 952781 | 11/1956 | Germany . |
| 400262 | 3/1978 | Sweden . |
| 435758 | 10/1984 | Sweden . |
| 465566 | 9/1991 | Sweden . |

OTHER PUBLICATIONS

Engsbraten, *New Blasting Method For Horizontal Holes Underground,* World Mining Congress, 1994, pp. 655 et seg.

*Primary Examiner*—Peter A. Nelson

*Attorney, Agent, or Firm*—Burns, Doane, Swecker & Mathis, L.L.P.

[57] ABSTRACT

A method for charging explosives in substantially horizontal bore-holes, with a loading density reduced in relation to that corresponding to the complete fill up of the bore-hole diameter with the explosive in bulk form, comprising that a charging hose with an end opening is introduced into at least one bore-hole of a blasting round, that a pumpable and coherent bulk explosive is pumped through the charging hose at a controlled rate, that simultaneous with the pumping of explosive the hose is withdrawn at a controlled rate, that the pumping and withdrawal rates are adjusted to form a coherent string exiting from the hose end opening, said exiting string only partially filling up the bore-hole diameter. An apparatus for charging explosives in bore-holes in controlled volume amount per bore-hole length unit comprises, a vessel (31) containing a pumpable and coherent bulk explosive (32), a charging hose (45) adapted for insertion into the hole-hole, a conduit (38) connecting the vessel with the hose, pumping means (33,34) for moving the explosive from the vessel through the conduit and the hose at a controlled rate, hose moving means (44,48) allowing forward movement of the hose and withdrawal of the hose at a controlled rate and adjusting means (34,48) for setting the ratio between the pumping rate and the hose withdrawal rate.

23 Claims, 1 Drawing Sheet

METHOD FOR CHARGING BORE-HOLES WITH EXPLOSIVE

This application is a continuation of application No. 08/200,487, filed Feb. 23, 1994, and now abandoned.

TECHNICAL FIELD

The present invention relates to a method for charging explosives in substantially horizontal bore-holes, with a loading density reduced in relation to that corresponding to the complete fill up of the bore-hole diameter with the explosive in bulk form. The invention also relates to an apparatus for charging explosives in bore-holes in controlled volume amount per bore-hole length unit.

BACKGROUND

In many blasting applications it is desirable to have a charging method providing explosive of reduced and variable bulk strength. In driving tunnels or galleries careful blasting of the contour holes will give a substantially undamaged rock face with strongly reduced needs for subsequent repair and support work such as bolting, gunniting, concrete reinforcement etc. and the final profile will be true to the design size. Similar considerations may arise in underground mining and stopig or for the purpose of limiting production of fines to meet certain after-processing constraints.

Although numerous small and closely spaced bore-holes can be used to produce smooth fracture planes, the method is limited by practical and economical reasons and conventionally careful blasting has been carried out by partial charging of oversized boreholes with small-diameter cartridges or tubes. Another approach is the arrangement of spatially separated and individually ignited deck charges at regular intervals in the borehole. The methods are expensive both in labour and equipment. Frequent problems are inconsistency in charging and uncontrolled coupling between explosive and rock. Detonation failures have also been experienced for certain explosives, supposedly due to pre-compression from forerunning shock waves in the free gas channel. Introduction of shells or spacers concentric with the charge have improved positioning but added to cost and complicated charging procedure.

To meet the general trend towards wider boreholes and bulk charging of explosives also in connection with careful blasting, bulk explosives of strongly reduced energy concentration have been developed, such as ANFO mixed with porous lightweight material. The complete fill out of large drill holes with explosive places severe demands for energy reduction and the explosive often approaches its detonation limit. Although the positioning problems mentioned in connection with the packaged products are avoided with bulk explosives, the coupling to the rock surface is stronger and the blast result will be markedly dependent on any inhomogenity present in the explosive. These problems are pronounced by the pulverulent nature of the explosives used. The lightweight materials usually employed for energy reduction are not easily mixed with the heavier standard components of the explosive. Precautions taken at manufacture to secure thorough mixing are not sufficient since the components tend to separate during transport and charging operation. The U.S. Pat. No. 4,995,925 describes an improved composition of this kind in which the segregation problems are controlled per se. The general problems with bore-holes filled up with reduced explosives are not solved, however, nor is the need for use of a single explosive composition for multiple strength requirement met by such explosives.

The U.S. Pat. No. 5,105,743 describes a method by which a standard blowable explosive is used to partially fill up a bore-hole. The method is limited to granular and blowable explosives and is of limited use in for example wet environments or other situations when pumpable explosives are needed. The method requires different tools for different bore-hole diameters and tend to give uneven amounts along the hole.

Unlike granular explosives, coherent and pumpable explosives of reduced diameter are susceptible to detonation propagation problems. Under proper detonation they tend to sustain a high detonation velocity, both unconfined and fully confined, which is not always consistent with cautious blasting requirements.

SUMMARY OF INVENTION

A primary object of the present invention is to provide method and device for charging and blasting bore-holes with pumpable explosives in reduced amounts. Another object is to provide such method and device suitable for cautious blasting. Still another object is to provide method and device allowing charging of pumpable explosives in easily varied specific loadings for different bore-hole requirements in the blast. Yet another object is to provide such varied charging with essentially the same explosive. A further object is to reach the abovesaid objects highly independent of bore-hole sizes. A final object is to obtain the stated purposes with different kinds of pumpable explosives and under optimal utilization of their respective energy reduction capabilities.

According to one aspect of the invention there is provided a method for charging explosives in substantially horizontal bore-holes, with a loading density reduced in relation to that corresponding to the complete fill up of the bore-hole diameter with the explosive in bulk form, which method comprises that a charging hose with an end opening is introduced into at least one bore-hole of a blasting round, that a pumpable and coherent bulk explosive is pumped through the charging hose at a controlled rate, that simultaneous with the pumping of explosive the hose is withdrawn at a controlled rate, that the pumping and withdrawal rates are adjusted to form a coherent string exiting from the hose end opening, said exiting string only partially filling up the bore-hole diameter.

According to another aspect of the invention there is provided an apparatus for charging explosives in bore-holes in controlled volume amount per bore-hole length unit, which apparatus comprises a vessel containing a pumpable and coherent bulk explosive, a charging hose adapted for insertion into the bore-hole, a conduit connecting the vessel with the hose, pumping means for moving the explosive from the vessel through the conduit and the hose at a controlled rate, hose moving means allowing forward movement of the hose and withdrawal of the hose at a controlled rate and adjusting means for setting the ratio between the pumping rate and the hose withdrawal rate.

By forming a string of pumpable explosive, only partially filling out a bore-hole diameter, several objectives are reached. The explosive itself need not be highly diluted, with corresponding problems, but energy reduction is accomplished by amount and string size. Variability in specific loading is obtained and specifically it is possible also to charge some bore-holes in their entirety with utilization of the full power of a bulk explosive. Yet, the most pronounced advantages are obtained in cautious blasting with thin strings of the explosive. It has been found that a pumpable bulk explosive string, uncoupled from the bore-hole wall and spacing devices, neither behaves as confined nor as unconfined, with high detonation velocities. Rather it detonates with a markedly reduced velocity and shock generation, perfectly meeting the requirements in cautious blasting. The charging method outlined and the detonation mechanism obtained sustains a stable and undisturbed detonation also in thin strings, contrary to previous experience. The method adapts to a great variety of pumpable bulk explosives, allowing selection of the proper explosive for each blasting environment, e.g. in respect of strength, water resistance, sensitivity etc. The method is compatible with both microsphere sensitized and gassed explosives. The latter explosive type may optionally benefit from the possibility of after-foaming into the free radial space without axial movements, thereby further increasing the sensitivity or lowering the critical detonation string size. The method requires no auxiliary devices over the explosive itself. The apparatus claimed forms the constructional basis for the critical parts of the charging method, supporting the abovesaid advantages.

Further objects and advantages will be evident from the detailed description hereinbelow.

DETAILED DESCRIPTION

The basic feature of forming a cohesive bulk explosive string, only partially filling up the bore-hole diameter, can be used for any kind of bore-holes in which the string can be properly positioned and retained up to initiation of the blast. Preferably the method is used for horizontal bore-holes or substantially horizontal bore-holes, which is to be understood to include also inclined holes insofar the string is stably retained therein.

Although most explosives have a gap sensitivity sufficient to bridge and maintain reaction also over certain interruptions in the string, it is preferred that the string formed is substantially cohesive over the length considered without any larger thinnings or discontinuities. Smaller irregularities are of no significance and may to some extent be unavoidable due to roughness on the bore-hole walls and other disturbances. The principles of the invention may be used for charging the entire or only part of the bore-hole length. Generally it is preferred that the major part of bore-hole length is charged with a string according to the invention.

The string may have a systematically varying cross-section area over bore-hole length. A preferred kind of variation is to have a decreasing area from the bore-hole inner part towards hole opening in order to meet the requirements for higher amounts in the innermost part of the hole. In most applications though, it is preferred to have a substantially constant cross-sectional area.

The method steps are adapted to give a string of above-said characteristics. The bore-hole is charged from the bottom or innermost part by pumping the explosive at a controlled rate from a charging hose under simultaneous withdrawal of the hose at a controlled rate. By mutually adjusting the pumping and withdrawal rates the desired string amounts can be extruded from the hose end. Both rates can be varying over time to give either a varying or a constant exiting explosive amount although it is preferred to keep at least one of the rates constant. When extruding a string of varying cross-sectional area it is preferred to keep the withdrawal rate constant and when extruding a string of constant cross-section to keep both rates constant.

Part of the bore-hole may be charged differently than with the string of the invention. Specifically igniting means in the form of detonators and/or primers are positioned in the bore-hole, commonly in the innermost part. In order to secure a safe ignition it is suitable to use an excess of explosive around the igniting means and preferably entirely fill up the bore-hole diameter around these devices. Similarly the outermost bore-hole parts may need less or no amounts of explosive. Excess charging can be obtained by a delay in hose withdrawal in relation to pump start and a reduction by slowing or stopping pumping.

Partial charging-is highly independent of absolute bore-hole diameter and the string charging of the invention may be utilized for broad size ranges. A non-limiting indication of suitable diameters is between 25 and 150 mm (1 and 6 inches) and preferably between 36 and 100 mm (1.5 and 4 inches).

A viscous explosive may flow and adapt to bore-hole shape even if extruded as a circular string. Hence partial charging degree shall here be expressed as the exiting string cross-section area to bore-hole cross-section area. In broad terms the charging degree so stated may lie between 10 and 90 percent and preferably between 20 and 80 percent.

The exact degree of partial charging depends on the purpose of the reduction. For the most preferred application in cautious blasting the lower charging degrees should be selected, such as between 10 and 75 percent or preferably between 15 and 60 percent. Too high degrees may give insufficient reduction and too low degrees insufficient breakage. In absolute terms string cross-section area may be between 1 and 20 sq. cm or preferably between 2 and 15 sq. cm.

As indicated, in partial string loading according to the invention it is possible, and in cautious blasting desirable, to strive for velocity of detonation (VOD) significantly lower than the velocity obtained both fully confined and fully unconfined. When utilizing this possibility the VOD may be between 25 and 75 percent, and preferably between 30 and 60 percent of the VOD for the same explosive, in the same string size, detonated freely on the ground. It may be that the bore-hole string is too thin to be detonated freely and in that case the abovesaid values should be compared with the smallest string freely detonatable. In absolute terms the VOD may be between 500 and 3500 m/sec and preferably between 1000 and 2500 m/sec.

Another application for the partial charging of the invention is to adapt charge strength to the specific need in each bore-hole, i.e. also drift holes and production holes, not particularly the contour holes. For this purpose a broader range of partial charging degrees can be used and in particular the higher charging degrees, such as 25 to 90 percent and preferably 30 to 75 percent.

According to the invention at least one bore-hole is partially charged with a string for any of the above purposes. In order to utilize the flexibility of the invention it is preferred to charge several bore-holes with different charge ratios, in particular several bore-holes to be blasted in the same round. It is within the scope of the invention that any of such additional bore-hole is fully charged, i.e. to substantially 100 percent as above, in order to utilize the full breadth of the invention.

It is within the scope of the invention that different explosives, e.g. with different strength, are used for different holes but the flexibility of the invention is best utilized if the same explosive is used for more than one hole and varying charge ratios.

The explosive should be a bulk explosive in order to avoid handling of cartridges or packages. Generally no filler materials or spacers should be used along the charge strings in the bore-hole. The explosive should be fluid or viscous, in contrast to pulverulent or granular, and should be coherent in the sense that the fluid or viscous phase is continuous around any solids present and the explosive cohesive both when pumped and in string form. The explosive should be pumpable, i.e. move as a single phase under pressure and have a sufficiently low viscosity to be moved through the charging hose, possibly with liquid lubrication, under not too high pressure loss. The explosive may be pumpable at elevated temperatures but it is preferred that it can be pumped at ambient temperatures. Explosives termed "repumpables" may be used.

The explosive may be sensitized by microspheres or by mechanical or chemical gassing or any combination therebetween. Microsphere sensitized explosives may be affected by pumping but are volume stable in the string after pumping. Gassed explosives offer the possibility to after-foam in the bore-hole following extrusion, either by pressure release or continued chemical reaction, the latter to be preferred, e.g for the purpose of increasing sensitivity or further reduce explosive strength in relation to the pumped explosive. The additional foaming may with preference take the explosive to lower than pumpable densities. Independent of the sensitizing method the pumped explosive should be regarded as the bulk form of the explosive for the purposes of the invention.

The preferred explosive types are gel explosives, slurry explosives and in particular water-in-oil type emulsion explosives, all optionally with additional solid oxidizer salts in amounts not destroying the cohesive character of the explosive. All these explosives are extensively described in the patent literature.

The emulsion explosives, having a continuous fuel phase and a discontinuous oxidizer phase, should preferably have a substantially all-oil fuel phase in order to be readily pumpable. The emulsion should have density reduced in relation to the void-free matrix of at least 10 percent by weight of the matrix, preferably at least 15 percent. In absolute terms the density could be below 1.3 g/cc and preferably below 1.25 g/cc. The lower limit is highly flexible and dependent on the degree of strength reduction desired. For high energy explosives or microsphere sensitized explosives the density reduction is generally limited to 40 and preferably also above 30 percent or in absolute terms above 0.80 or above 0.9 g/cc. Gassed and after-foamed emulsions may have even lower densities, with density reductions of at least 50 and even 60 percent or absolute densities down to 0.7 g/cc or even down to 0.5 g/cc.

A suitable apparatus for carrying out the method of the invention and for charging explosive in a controlled volume amount per bore-hole length unit should include a vessel for the explosive and a charging hose for insertion into the bore-hole and a conduit connecting these devices.

The conduit should include a pump able to feed the pumpable explosive at a controlled and stable volume rate, which rate should preferably be variable in order to allow different degrees of partial charging. Positive displacement pumps giving small flow rate variations, such as "monopumps", may be used.

In case the explosive is to be chemically gassed the conduit may include an inlet for gassing agent, normally a liquid, and possibly a vessel for such an agent and a pump for moving and dosing the agent into the conduit. A mixing device should be present in the conduit after the inlet in order to evenly distribute the agent in the explosive. The pump may act as a mixing device but it is preferred to arrange the inlet after the pump and insert a mixer after the inlet, preferably a static mixer. In the extreme, the mixer may be positioned at the end of the charging hose, optionally with a small tube parallel with the hose to an inlet immediately prior to the mixer.

In order to reduce the pressure requirements in pumping the explosive it is suitable to arrange for introduction of a lubricating fluid between the conduit and hose interior surface and the explosive. The fluid may be water but is preferably an aqueous solution of oxidizing salts similar to those present in the explosive itself. The arrangements may comprise an inlet for the lubricating liquid ending in an annular chamber surrounding the channel of the conduit and having a ring opening towards the channel for forming a liquid ring around the centrally fed explosive.

The apparatus should include means for moving the hose. At least these means should allow forward movement of the hose when inserted into the bore-hole and driving means for withdrawing the hose at a controlled rate. The rate can be variable during charging operation but is preferably constant. The rate is preferably adjustable. Suitably the driving means also assists in the forward motion of the hose.

Any type of moving means fulfilling these requirements can be used for the purposes of the invention. One type of such moving means includes opposed wheels or bands gripping a part of the hose therebetween and driving means connected to at least one of the opposed wheels or bands able to move the hose at least in the withdrawal direction. A preferred device of this kind is described in the Swedish patent 8903101-7 (465 566). The device is highly flexible and allows strongly variable feeding speeds both in forward and reverse directions.

Another preferred type of hose moving means includes a winder or reel with guiding means for receiving turns of the charging hose on its peripheral parts, preferably in a monolayer, and driving means for rotating the winder in a direction withdrawing the hose from the bore-hole towards the winder at a controlled rate. This device may include disengaging means allowing manual unwinding of the hose under rotation of the winder. The guiding means may include restricting means preventing radial expansion of hose turns on the winder, except at a point of unwinding, whereby the hose is securely retained on the winder and pushing actions are also made possible.

The apparatus should also include adjusting means for setting the ratio between the controlled pumping rate and the controlled hose withdrawal rate, in order to expel the explosive in the volume rate desired to give the string characteristics stated. The adjusting means may include means for varying the pumping rate and/or the withdrawal rate. A simple, yet for many purposes sufficient, arrangement is to use adjusting means giving constant withdrawal rate and variable pump rates. Hydraulic motors are preferred driving means for pump and withdrawal means, allowing a broad range of stable rates.

DESCRIPTION OF DRAWINGS

Figure 1:
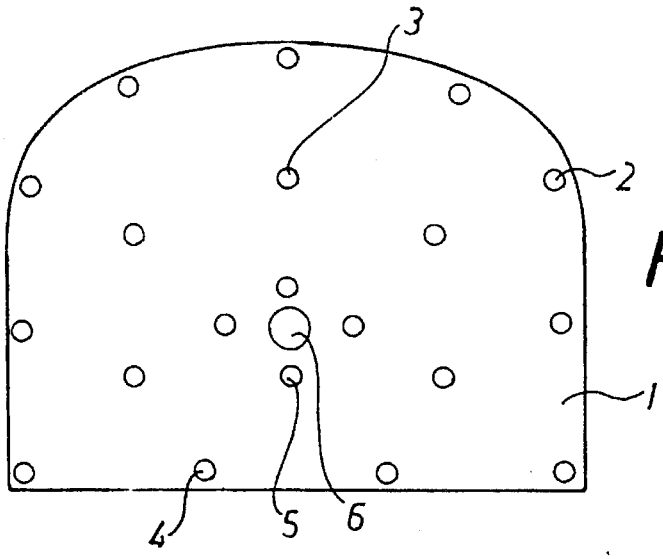
FIG. 1 illustrates a simplified bore-hole pattern of an underground tunnel with different bore-hole types.

The tunnel profile of FIG. 1 shows a number of bore-holes provided in the rock face 1. Several contour holes 2 along roof and side walls are suitably weakly charged with for example a partial charging degree of 25 percent as defined. Holes next to the contour holes (not shown) are charged to an intermediate degree of for example 50 percent. Remaining holes, including drift holes 3 and foot holes 4 as well as holes 5 close to the central empty cut 6 can be entirely filled to a charge degree of 100 percent. The same explosive is suitably used for all the holes.

Figure 2:
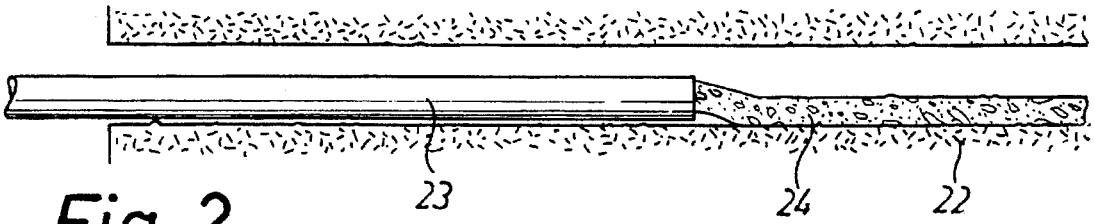
FIG. 2 illustrates the formation of an explosive string in a bore-hole according to the invention.

FIG. 2 shows in side view a bore-hole 21 in rock 22. Through charging hose 23 is pumped an explosive under simultaneous withdrawal of the hose. A uniform string of the explosive is formed which string only partially fills up the available radial space in the hole.

Figure 3:
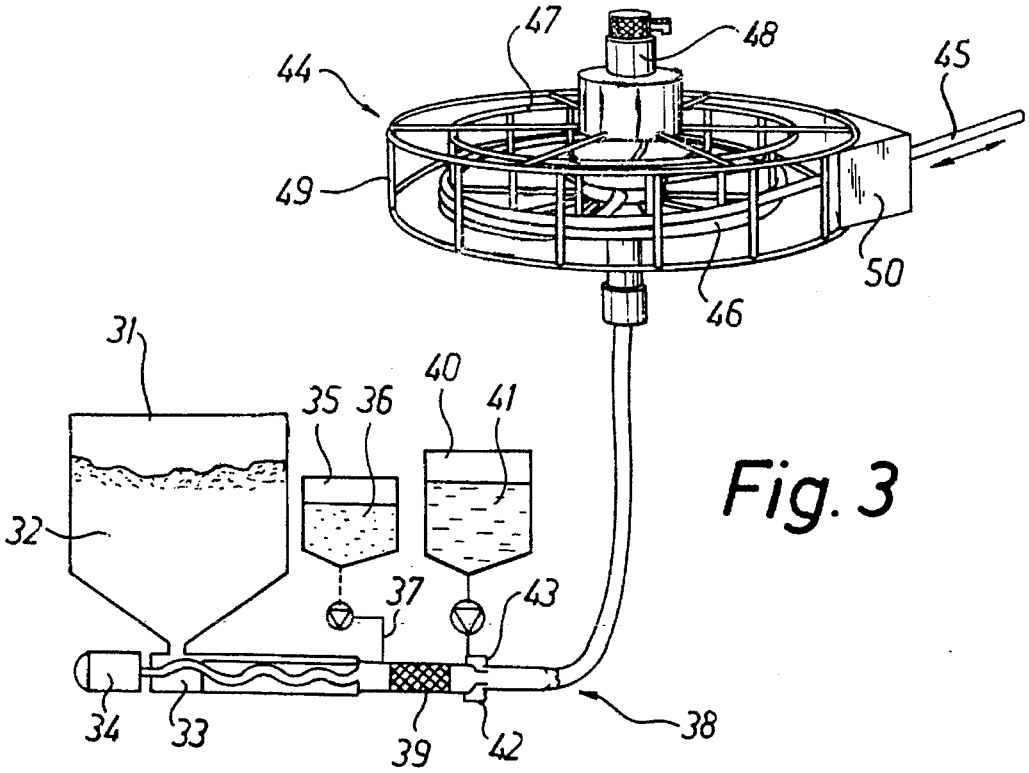
FIG. 3 illustrates schematically a preferred apparatus for string formation according to the invention.

FIG. 3 shows in perspective view a suitable charging apparatus for the method of the invention. The apparatus comprises a vessel 31 containing a pumpable explosive 32 feeding into a pump 33 with motor 34. A vessel 35 containing gassing agent 36 is via inlet 37 connected to the conduit, generally designated 38. A static mixer 39 is provided to mix the gassing agent with the explosive. A vessel 40 containing lubricating liquid 41 is connected to an annular chamber 42 surrounding the central part of conduit 38. The chamber 42 has a ring opening 43 through which the liquid feeds into the conduit between the inner surface thereof and the centrally pumped explosive. The conduit 38 terminates in the central part of a winder or reel 44. A charging hose 45, connected to the central termination of conduit 38, is placed in a monolayer of turns 46 on the periphery of inner cage 47. The inner cage is rotatable at constant speed by actuating means 48. An outer cage 49 is rotatable coaxially with, but independent of, inner cage 47 and have periphery means limiting radial movements of charging hose turns 46. At exit 50 the hose can be withdrawn or extended under simultaneous winding or unwinding on rotating inner cage 47.

EXAMPLE 1

A water-in-oil type emulsion explosive was prepared by forming a fuel phase containing 7 parts by weight of a process oil (Nyflex 8130) including 1 part emulsifier (Lubrizol 5691B) and 93 parts oxidizer phase, containing 66 percent by weight ammonium nitrate, 18 percent sodium nitrate and 16 percent water. The two phases were emulsified at about 75 centigrades high shear mixer (CR-mixer) to a final viscosity of about 37.000 cps at the preparation temperature. To this matrix glass microspheres (Q-cell 723) were added in an amount sufficient to give a warm emulsion density of about 1.18 g/cc corresponding to a cold emulsion density of about 1.20 g/cc.

This emulsion was charged into various steel tubes having outer diameters between 20 and 51 mm and wall thicknesses of about 3 mm. When completely filled with the emulsion, and initiated with detonator and 50 g primer, the charges detonated with velocities between 5048 and 5652 m/sec. An estimated velocity for an unconfined charge of 50 mm diameter is about 5000 m/sec.

The same type of emulsion was charged into two 40 mm steel tubes of the same wall thickness and a length of 3 m in an amount corresponding to half the cross-section area of the tube. The detonation velocity was measured at 7 points separated 30 cm along the tube. Apart from the first measuring sections, where detonation velocity was affected by the primer used, the detonation velocity stabilized at between 2000 to 2500 m/sec.

EXAMPLE 2

Transparent plastic tubes of inner diameter 42 mm were partially filled with explosive according to Example 1, using an apparatus similar to that described in relation to FIG. 3, although without the parts relating to gassing. The liquid ring was fed with water in an amount of 3 percent by weight of the emulsion flow. The apparatus had hydraulic motors for the winder and the pump with adjustable hose and pump rates.

A great number of charging tests were done with the apparatus, in each case with different although during charging constant pump and winder rates. Strings obtained were examined and weighed. The strings had small size variations and expected and reproducible results were obtained with various apparatus settings.

EXAMPLE 3

In a commercial tunnel drifting one of the contour holes were charged according to the invention and initiated together with the other holes in the round. The charged hole was about 41 mm in diameter and had a length of 3.7 m and was initiated from the bottom with a 29×200 mm NG (Dynemax) primer. The hole was charged with the same type of emulsion as in Example 1 in an amount of 0.3 liter per meter of the hole, corresponding to a partial filling degree of about 23 percent of the cross-section area.

The detonation velocity was measured over two distances in the bore-hole, well separated from the initial part affected by the primer. The velocity was measured in such single bore-holes of a round at six different occasions. The velocities measured varied between 1320 and 2420 m/sec and no detonation interruptions were experienced. The charge operated in the intended way, leaving readily visible semicircular bore-hole remnants on the rock face.

EXAMPLE 4

In the same tunnel as in Example 3 all the bore-holes of the round (except some control holes) were charged with the same type of explosive and the same apparatus. All the holes were completely filled with the explosive, except the contour holes for the walls and the roof, which were partially filled to 23 percent, and the holes immediately inside the contour holes which were partially filled to about 50 percent.

The control holes in the contour were charged with conventional plastic 22 and 17 mm tube charges containing granular explosives (Gurit).

The round gave good advance and fragmentation. The contour was undamaged with equivalent good results for holes shot with emulsion and tube charges.

EXAMPLE 5

About 70 full tunnel profiles have been charged and shot substantially as in Example 4. Under slightly varying conditions similar results were obtained with the same charging pattern. With fully charged holes next to the profile the final rock face was damaged.

EXAMPLE 6

An emulsion matrix according to Example 1 is prepared. No microspheres are added but the oxidizer phase contained an acidic acid additive in an amount of 0.2 percent by weight of the entire emulsion. Using the apparatus of FIG. 3, a gassing agent containing 35 percent aqueous solution of sodium nitrite and an accelerator of natrium thiocyanate is fed from the gassing agent vessel into the conduit in an amount sufficient to give a density of about 1.15 g/cc after extrusion and a reaction time of about 20 minutes, which density then remains substantially constant.

The same tunnel profile as in Example 4 is charged with the explosive with roughly the same weight amount of explosive per meter bore-hole in corresponding types of holes over the profile. The filled up holes are charged to an initial filling degree of about 85 to 90 percent, allowing space for radial expansion during foaming. The contour holes and the holes immediately inside the contour holes are only partially filled after gassing as in the previous example, although with a density somewhat lower of about 1.0 g/cc which is obtained by a slightly higher ratio of gassing agent to matrix when charging these holes. Similar results are obtained as with the rounds using microsphere sensitised explosive.

We claim:

1. A method for charging explosives in substantially horizontal bore-holes, with a loading density reduced in relation to that corresponding to the complete fill up of the bore-hole diameter while using a cohesive pumpable emulsion explosive composition in bulk form comprising:

(a) introducing a charging hose with an end opening into at least one substantially horizontal bore-hole of a blasting round, (b) pumping an emulsion explosive composition in fluid or viscous form as a cohesive mass through the charging hose at a controlled rate into said at least one substantially horizontal bore-hole, (c) withdrawing said charging hose at a controlled rate simultaneously with said pumping, and (d) adjusting said pumping rate and said withdrawing rate so as to form while exiting from said hose end opening a coherent string of said emulsion explosive composition with said exiting string only partially filling up the substantially horizontal bore-hole diameter.

2. The method of claim 1 wherein the partial filling up of said bore-hole diameter is between 10 and 90 percent over a substantial part of the bore-hole length.

3. The method of claim 1 wherein the pumping and withdrawal rates are adjusted to give a varying string cross-sectional area over the bore-hole length.

4. The method of claim 3 wherein the string cross-sectional area decreases towards the bore-hole opening.

5. The method of claim 1 wherein the pumping and withdrawal rates are adjusted to give a substantially constant string cross-sectional area over a substantial part of the bore-hole length.

6. The method of claim 1 wherein the hose withdrawal rate is substantially constant.

7. The method of claim 1 wherein igniting means are introduced into the bore-hole.

8. The method of claim 7 wherein said igniting means are positioned close to the bore-hole innermost part and that the pumping and withdrawal rates are adjusted to give an explosive amount at the igniting means in excess of the string amount in the main part of the bore-hole length.

9. The method of claim 8 wherein said excess amount is obtained by a delay of hose withdrawal after the start of pumping.

10. The method of claim 1 wherein said cohesive pumpable emulsion explosive composition is a water-in-oil emulsion explosive which includes solid oxidizer salts in amounts that do not destroy said cohesive character.

11. The method of claim 1 wherein said cohesive pumpable emulsion explosive composition contains microspheres as a sensitizing agent.

12. The method of claim 1 wherein said cohesive pumpable explosive emulsion composition contains a gassing agent as a sensitizing agent.

13. The method of claim 12 wherein said gassing agent in the exiting string is further reacted in the bore-hole following said charging to radially expand the string by foaming.

14. The method of claim 13 wherein after said radial expansion the string substantially fills up the bore-hole cross-section.

15. The method of claim 1 wherein at least two different bore-holes in the blasting round are charged to different ratios of string cross-sectional area to bore-hole cross-sectional area.

16. The method of claim 15 wherein at least one bore-hole is charged with a string that fills up the bore-hole cross-sectional area.

17. The method of claim 1 wherein the bore-hole has a diameter of between 25 and 150 mm.

18. The method of claim 1 wherein the string cross-sectional area is between 1 and 20 sq. cm.

19. The method of claim 1 wherein the velocity of detonation in the string is between 500 and 3500 m/sec.

20. The method of claim 1 wherein the partial filling up of said bore-hole diameter is between 20 and 80 percent over a substantial part of the bore-hole length.

21. The method of claim 1 wherein the bore-hole has a diameter of 36 to 100 mm.

22. The method of claim 1 wherein the string cross-sectional area is between 2 and 15 sq. cm.

23. The method of claim 1 wherein the velocity of detonation in the string is between 1000 and 2500 m/sec.

* * * * *